US008717273B2

(12) United States Patent
Hachida et al.

(10) Patent No.: US 8,717,273 B2
(45) Date of Patent: May 6, 2014

(54) LIQUID CRYSTAL DISPLAY DEVICE AND DRIVE METHOD FOR LIQUID CRYSTAL DISPLAY DEVICE

(75) Inventors: Takuya Hachida, Osaka (JP); Yasushi Sasaki, Osaka (JP); Yuhichiroh Murakami, Osaka (JP); Shuji Nishi, Osaka (JP); Seijirou Gyouten, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 89 days.

(21) Appl. No.: 13/395,998

(22) PCT Filed: Jun. 25, 2010

(86) PCT No.: PCT/JP2010/060861
§ 371 (c)(1),
(2), (4) Date: Apr. 2, 2012

(87) PCT Pub. No.: WO2011/033836
PCT Pub. Date: Mar. 24, 2011

(65) Prior Publication Data

US 2012/0188218 A1 Jul. 26, 2012

(30) Foreign Application Priority Data

Sep. 16, 2009 (JP) ..... 2009-215064

(51) Int. Cl.
*G09G 3/36* (2006.01)

(52) U.S. Cl.
USPC ..... 345/98; 345/99

(58) Field of Classification Search
USPC ..... 345/98–100, 211
See application file for complete search history.

(56) References Cited

U.S. PATENT DOCUMENTS

2002/0075205 A1 6/2002 Kimura et al.
2004/0066360 A1 4/2004 Tobita

FOREIGN PATENT DOCUMENTS

JP 2002-123222 A 4/2002
JP 2002-229532 A 8/2002
WO WO-03-067316 A1 8/2003

OTHER PUBLICATIONS

International Search Report.

*Primary Examiner* — Ricardo L Osorio
(74) *Attorney, Agent, or Firm* — Harness, Dickey & Pierce, P.L.C.

(57) ABSTRACT

A memory-type liquid crystal display device includes a liquid crystal panel including memory circuits, and conducts a refresh operation more than once during a display holding period after rewriting of a screen. The memory-type liquid crystal display device increases at least one of (i) a frequency at which the screen is rewritten and (ii) a frequency at which the refresh operation is conducted during the display holding period as an intensity of light received by the liquid crystal panel increases. This allows the memory-type liquid crystal display device to reduce power consumption while keeping its display quality.

11 Claims, 10 Drawing Sheets

LIQUID CRYSTAL DISPLAY DEVICE AND DRIVE METHOD FOR LIQUID CRYSTAL DISPLAY DEVICE

TECHNICAL FIELD

The present invention relates to a memory-type liquid crystal display device.

BACKGROUND ART

A memory-type liquid crystal display device is suitably applicable to, for example, (i) a subscreen of a mobile phone or the like or (ii) an electronic tag, which displays a static image for a relatively long period of time. The memory-type liquid crystal display device merely refreshes a screen during a display holding period (a memory operating period) after rewriting of the screen. Therefore, the memory-type liquid crystal display device has a merit of consuming less power.

As shown in, for example, FIG. 11 (see Patent Literature 1), a memory-type liquid crystal display device includes a main transistor Ta1, a pixel pix1 including a pixel electrode pe1, and a memory circuit mc1 for the pixel pix1. During a display holding period, the memory circuit mc1 is operated by drivings of a gate line gL1, a transfer line tL1, and a refresh line rL1. This allows a refresh operation to be conducted. In the refresh operation, two electric potentials (High electric potential and Low electric potential) are alternately applied to the pixel electrode pe1.

CITATION LIST

Patent Literature

Patent Literature 1

Japanese Patent Application Publication, Tokukai No. 2002-229532 A (Publication Date: Aug. 16, 2002)

SUMMARY OF INVENTION

Technical Problem

However, a liquid crystal display device displays by use of a backlight or external light. Therefore, operations of a main transistor Ta1 and transistors of a memory circuit mc1 are affected by light. For example, in a case where an intensity of light received by a panel (a light-receiving intensity) increases, leak current of the main transistor and the transistors of the memory circuit is increased, and therefore an image quality of the liquid crystal display device is likely to be deteriorated during a display holding period. It is therefore necessary to determine a rewritten frequency and a refresh frequency on the assumption that the light-receiving intensity is high. However, in a case where the light-receiving intensity is low, such a determination causes the liquid crystal display device to be beyond its electric specification. This results in wasteful power consumption.

The present invention provides a memory-type liquid crystal display device that reduces power consumption while keeping its display quality.

Solution to Problem

A liquid crystal display device of the present invention, is a liquid crystal display device of memory-type, including a liquid crystal panel including memory circuits, which conducts a refresh operation more than once during a display holding period after rewriting of a screen, wherein at least one of (i) a frequency at which the screen is rewritten and (ii) a frequency at which a refresh operation is conducted during the display holding period, is increased as an intensity of light received by the liquid crystal panel increases.

In the liquid crystal display device of the present invention, at least one of (i) the frequency at which the screen is rewritten and (ii) the frequency at which the refresh operation is conducted during the display holding period is increased, and at least one of intervals at which the screen is rewritten and intervals at which the refresh operation are conducted is shortened, in a case where a state of a low light-receiving intensity where an image quality is unlikely to be deteriorated is changed, during the display holding period, to a state of a high light-receiving intensity where the image quality is likely to be deteriorated. This allows the liquid crystal display device of the present invention to reduce power consumption while keeping its display quality.

BRIEF DESCRIPTION OF DRAWINGS

FIG. 1 is a view schematically showing an example of an operation of a liquid crystal display device of the present invention (in a case of a high light-receiving intensity, and in a case of a low light-receiving intensity).

FIG. 2 is a block diagram showing a configuration of the liquid crystal display device of the present invention.

FIG. 3 is a circuit diagram showing a configuration of a pixel of a memory-type liquid crystal panel for use in the liquid crystal display device of the present invention.

FIG. 4 is a timing chart showing an operation of the liquid crystal display device of the present invention.

FIG. 5 is a timing chart showing an operation of the liquid crystal display device of the present invention (in a case of a high light-receiving intensity, and in a case of a low light-receiving intensity).

FIG. 6 is a view schematically showing a clock selection circuit and a frequency dividing circuit of the liquid crystal display device of the present invention.

FIG. 7 is a block diagram showing another configuration of the liquid crystal display device of the present invention.

FIG. 8 is a circuit diagram showing an example configuration of an optical sensor for use in the liquid crystal display device of the present invention.

FIG. 9 is a timing chart showing an operation of the optical sensor of FIG. 8.

FIG. 10 is a view schematically showing another example of an operation of the liquid crystal display device of the present invention (in a case of a high light-receiving intensity, and in a case of a low light-receiving intensity).

FIG. 11 is a circuit diagram showing a configuration of a pixel of a conventional memory-type liquid crystal panel.

DESCRIPTION OF EMBODIMENTS

[Embodiment 1]

Figure 1:
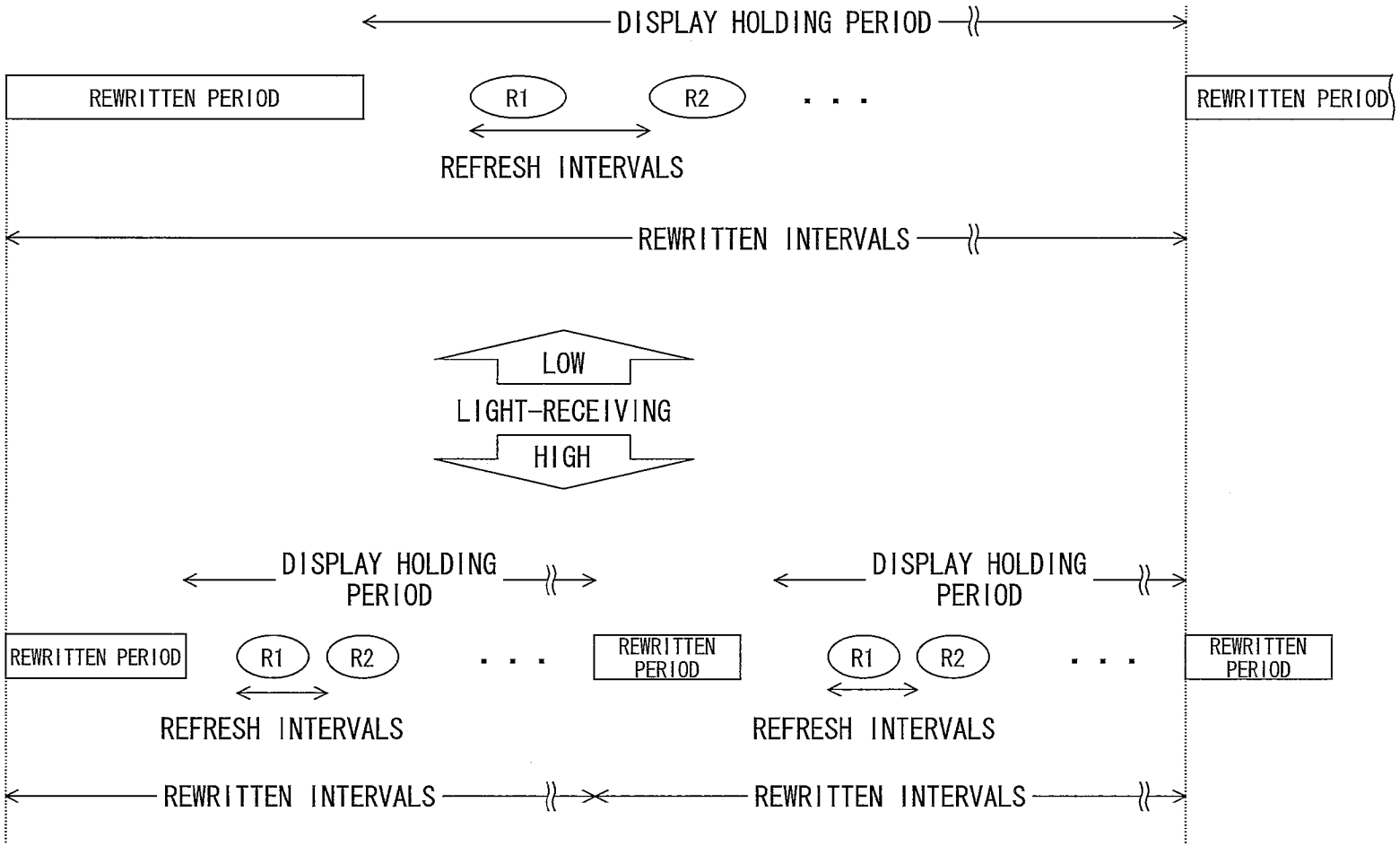
FIG. 1
Figure 2:
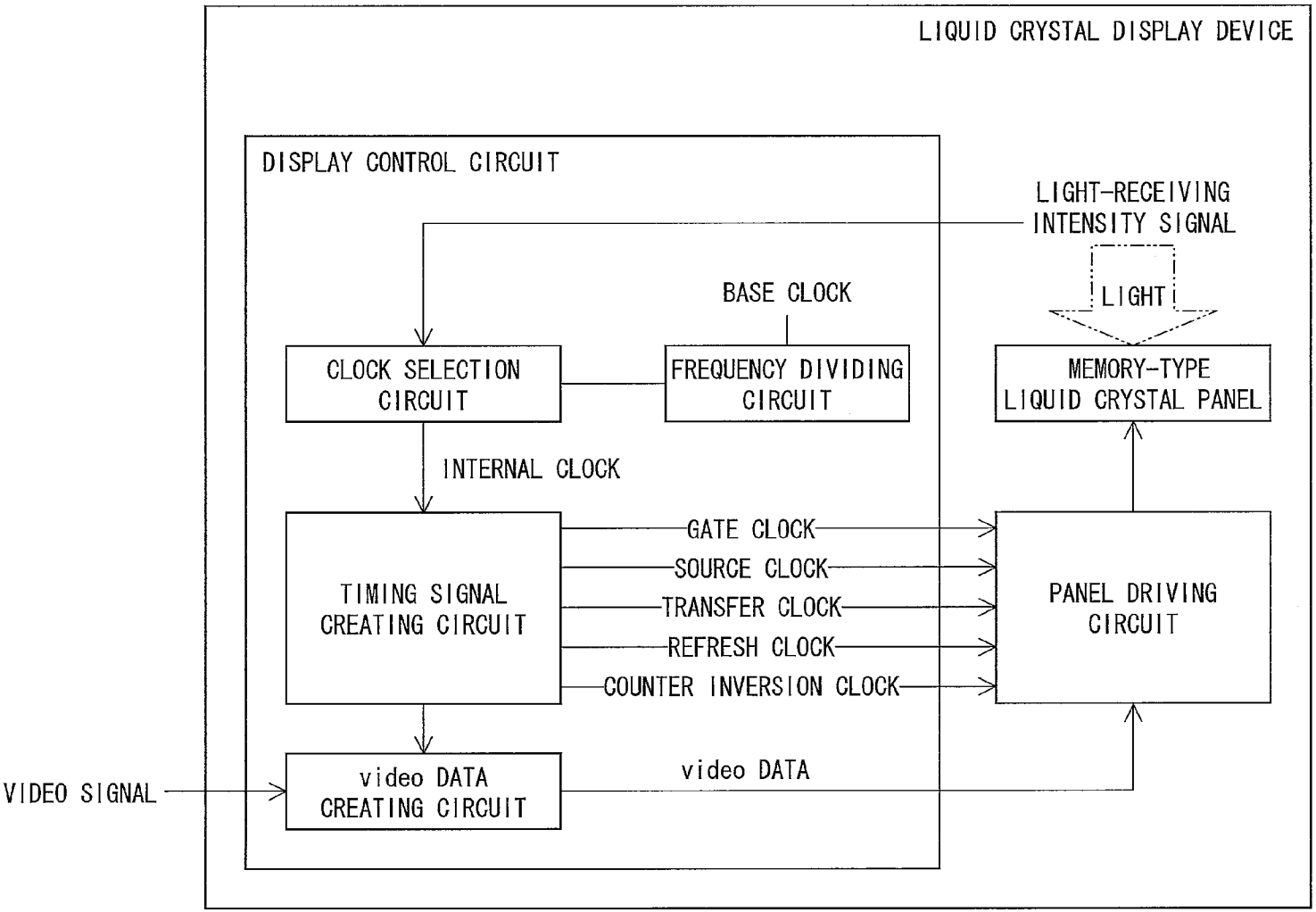
FIG. 2

The following description will discuss an embodiment of the present invention with reference to FIGS. 1 through 11. FIG. 2 is a block diagram showing a configuration of a liquid crystal display device of the present invention. As shown in FIG. 2, the liquid crystal display device of the present embodiment is a memory-type liquid crystal display device that conducts a refresh operation more than once during a display holding period after rewriting of a screen. The memory-type liquid crystal display device includes a memory-type liquid crystal panel, a panel driving circuit for driving the memory-type liquid crystal panel, and a display control circuit for controlling the panel driving circuit. The display control circuit includes a video data creating circuit, a timing signal creating circuit, a clock selection circuit, and a frequency dividing circuit. The memory-type liquid crystal panel includes gate lines, source lines, transfer lines, refresh lines, and retention capacitor lines (CS lines) (all not shown). The display control circuit receives a light-receiving intensity signal indicative of an intensity of light received from a backlight or external light (such as solar light or illumination light) received by the memory-type liquid crystal panel.

The frequency dividing circuit creates a plurality of clocks from a base clock, and then supplies the plurality of clocks to the clock selection circuit. An optical sensor creates a light-receiving intensity signal, and then supplies the light-receiving intensity signal to the clock selection circuit. The clock selection circuit selects, from the plurality of clocks, a clock in accordance with the light-receiving intensity signal, and then supplies, as an internal clock, the clock to the timing signal creating circuit. The timing signal creating circuit creates, in response to the internal clock, (i) a gate clock for driving a gate line, (ii) a source clock for driving a source line, (iii) a transfer clock for driving a transfer line, (iv) a refresh clock for driving a refresh line, and (v) a counter inversion clock for driving a counter electrode (common electrode) of the memory-type liquid crystal panel. The timing signal creating circuit then supplies created clocks to the panel driving circuit. The video data creating circuit creates video data in response to (i) a signal supplied from the timing signal creating circuit and (ii) an externally supplied video signal, and then supplies the video data to the panel driving circuit. The panel driving circuit creates a gate signal to be supplied to the gate line, a transfer signal to be supplied to the transfer line, a refresh signal to be supplied to the refresh line, and a counter inversion signal to be supplied to the counter electrode, in response to the gate clock, the transfer clock, the refresh clock, and the counter inversion clock, respectively. The panel driving circuit also creates, in response to the source clock and the video data, a data signal to be supplied to the source line SL.

In the above-configured liquid crystal display device of the present invention, the gate clock, the source clock, the transfer clock, and the refresh clock are switched in accordance with a light-receiving intensity. This causes a change in driving frequency of each of the gate signal, the data signal, the transfer signal, and the refresh signal. Specifically, as a light-receiving intensity of the memory-type liquid crystal panel becomes stronger, (i) the driving frequency of each of the signals becomes higher, (ii) a frequency, at which a screen is rewritten, becomes higher (time intervals, at which a screen is rewritten, becomes narrower), and (iii) a frequency, at which a screen is refreshed during a display holding period, becomes higher (time intervals, at which a screen is refreshed, becomes narrower) (see FIG. 1).

Figure 3:
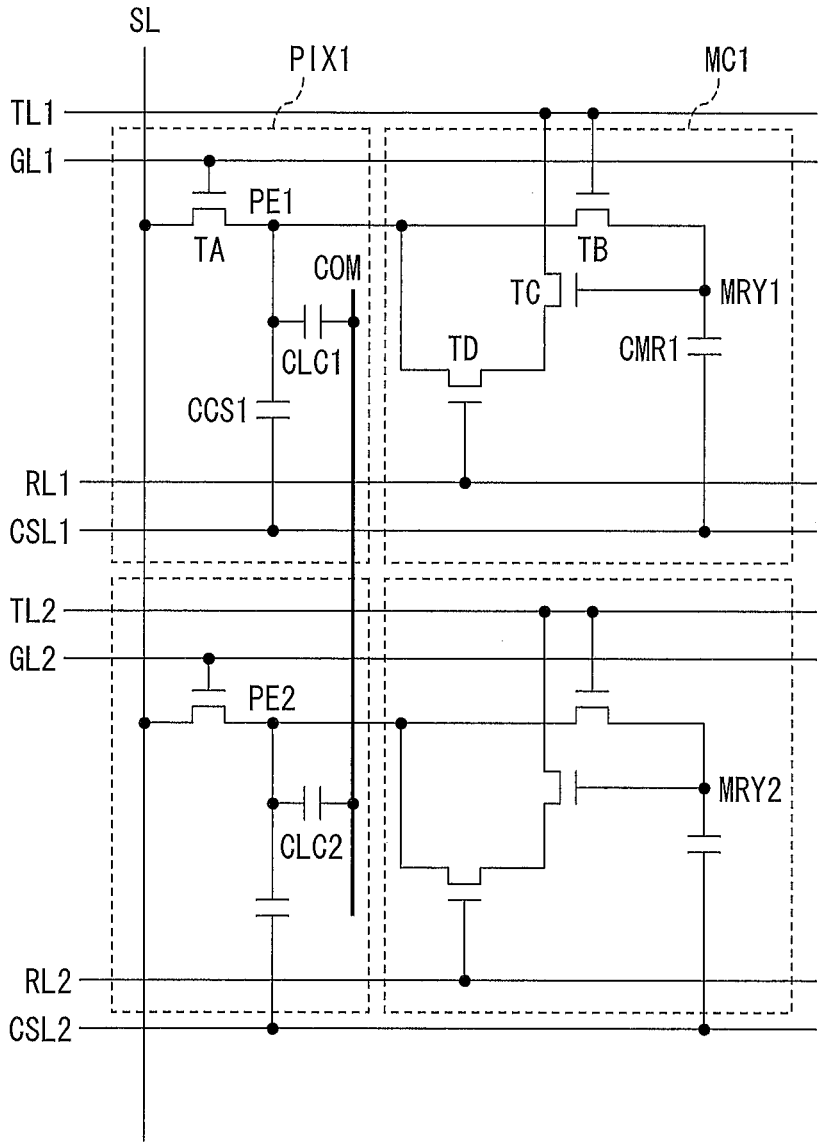
FIG. 3
Figure 4:
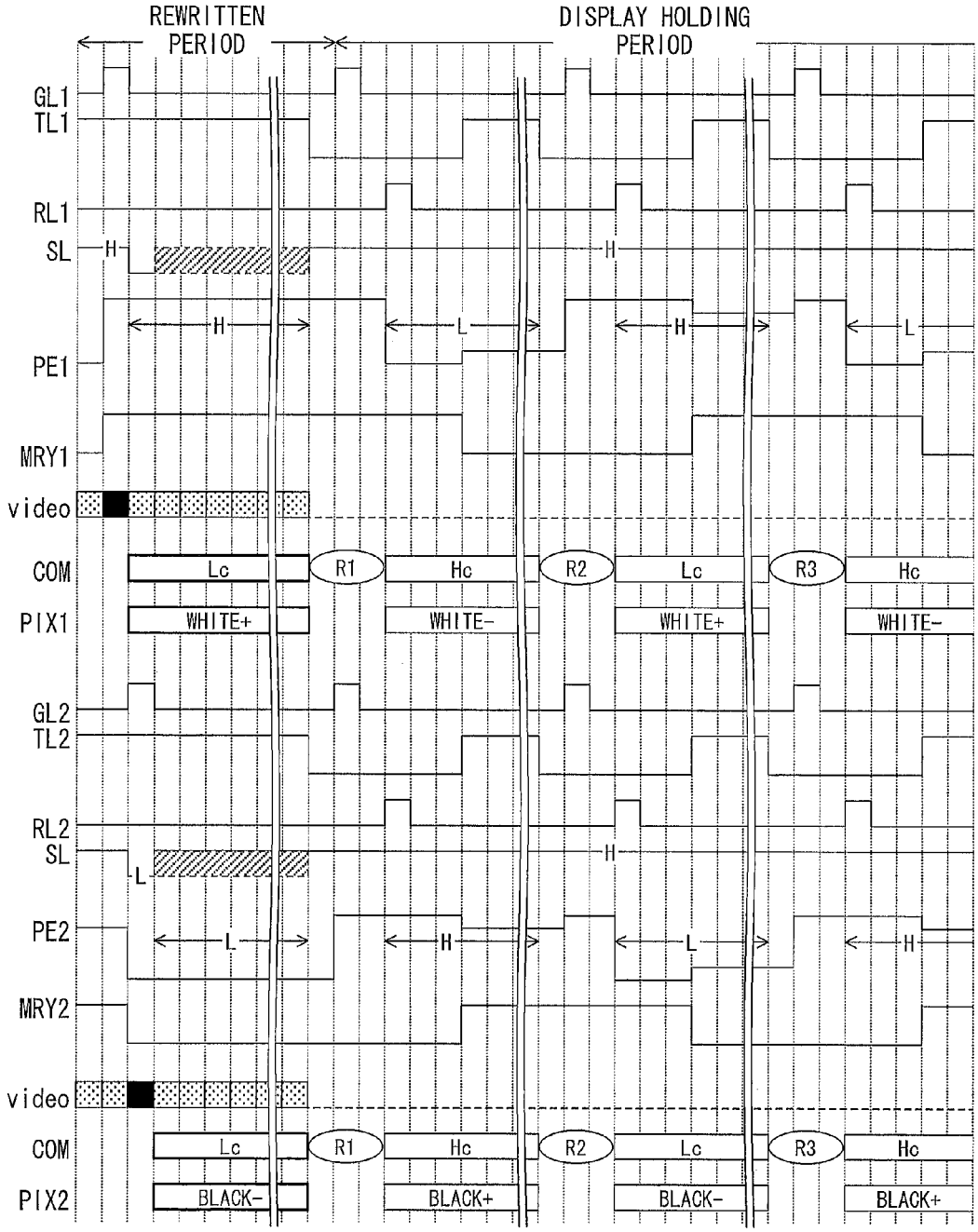
FIG. 4

FIG. 3 is an equivalent circuit diagram showing a partial configuration (two pixels adjacent in a direction in which a source line extends) of a memory-type liquid crystal panel of the liquid crystal display device of the present embodiment. FIG. 4 is a timing chart showing how the two pixels are driven. The memory-type liquid crystal panel of the present embodiment includes a gate line GL1, a source line SL, a transfer line TL1, a refresh line RL1, a retention capacitor line SCL1, a main transistor TA1 whose gate terminal is connected to the gate line GL1, a pixel PIX1 including (i) a pixel electrode PE1 and (ii) a counter electrode com, and a memory circuit MC1 for the pixel PIX1 (see FIG. 3). The memory circuit MC1 includes a transfer transistor TB whose gate terminal is connected to the transfer line TL1, a refresh transistor TD whose gate terminal is connected to the refresh line RL1, a memory electrode MRY1, and a relay transistor TC whose gate terminal is connected to the memory electrode MRY1. A liquid crystal capacitor CLC1 is defined by the pixel electrode PE1 and the counter electrode com. A retention capacitor CCS1 is defined by the retention capacitor wiring CSL1 and the pixel electrode PE1. A memory capacitor CMR1 is defined by the retention capacitor line CSL1 and the memory electrode MRY1.

The main transistor TA has a source terminal connected to the source line SL, and a drain terminal connected to the pixel electrode PE1. The relay transistor TC has a source terminal connected to the transfer line TL1. The pixel electrode PE1, a source terminal of the transfer transistor TB, and a source terminal of the refresh transistor TD are connected to one another. The relay transistor TC has a drain terminal connected to a drain terminal of the refresh transistor TD. The transfer transistor TB has a drain terminal connected to the memory electrode MRY1.

The following description will discuss, with reference to FIG. 4, how the pixel PIX1 operates during a rewritten period and during a display holding period. Note that, in FIG. 4, GL1 shows a waveform of a gate signal to be supplied to the gate line GL1, SL shows a waveform of a data signal to be supplied to the source line SL, TL1 shows a waveform of a transfer signal to be supplied to the transfer line TL1, RL1 shows a waveform of a refresh signal to be supplied to the refresh line RL1, PE1 shows a waveform of an electric potential of the pixel electrode PE1, and MRY1 shows a waveform of an electric potential of the memory electrode MRY1.

During the rewritten period, the pixel PIX1 operates as follows. The gate line GL1 first becomes active (High). This causes the main transistor TA to be turned on. Therefore, a data signal of High (an electric potential H) is written in the pixel electrode PE1, via the source line SL, so that the liquid crystal capacitor CLC1 and the retention capacitor CCS1 are charged. While the gate line GL1 is being active, the transfer line TL1 is also active (High). This causes a data signal of High (an electric potential H) to be also written in the memory electrode MRY1, via the source line SL and the transfer transistor TB, so that the memory capacitor CMR1 is charged. Subsequently, the gate line GL1 becomes inactive (Low). This causes the pixel electrode PE1 to get in a floating state. Theoretically, the electric potential of the pixel electrode PE1 is held but actually changes over time the electric potential of the pixel electrode PE1 due to, for example, off-leakage current of the main transistor TA. In order to hold the electric potential of the pixel electrode PE1, a screen is periodically refreshed during the display holding period. Note that the counter electrode COM has an electric potential VCOM of Lc ($L<Lc<H$) in response to a counter inversion signal during the rewritten period. Hence, the pixel PIX1 displays white (polarity is positive).

During the display holding period, the pixel PIX1 operates as follows. Note that an electric potential H (constant electric potential) is supplied to the source line SL during the display holding period. While the first operation is started and the transfer line TL1 is being inactive (Low), the memory electrode MRY1 is electrically disconnected from the pixel electrode PE1. This causes the memory electrode MRY1 to hold an electric potential H. Subsequently, the gate line GL1 becomes active (High), and an electric potential H is written in the pixel electrode PE1 via the source line SL. Note that the transfer transistor TB is still in an off-state, and therefore the memory electrode MRY1 holds the electric potential H. When the refresh line RL1 becomes active (High), the refresh transistor TD is turned on. The pixel electrode PE1 and the transfer line TL1 are short-circuited via the refresh transistor TD and the relay transistor TC. This is because the relay transistor TC whose gate terminal is connected to the memory electrode MRY (holding the electric potential H) is turned on while the refresh transistor TD is in an on-state. This causes the pixel electrode PE1 to have an electric potential equal to Low (electric potential L) that is an electric potential of the transfer line TL1. The first refresh operation is thus ended. Subsequently, when the transfer line TL1 becomes active (High), the pixel electrode PE1 and the memory electrode MRY1 are short-circuited, and the electric potential of the pixel electrode PE1 is increased whereas the electric potential of the memory electrode MRY1 is decreased. Note that the retention capacitor CCS1 is designed to have capacitance greater than that of the memory capacitor CMR1. Therefore, the electric potential of the memory electrode MRY1 is decreased from the electric potential H to the vicinity of an electric potential L, and the pixel electrode PE1 keeps an electric potential equal to that of the memory electrode MRY1 (in the vicinity of the electric potential L) though the electric potential of the pixel electrode PE1 is slightly increased from the electric potential L. Note that the electric potential VCOM becomes an electric potential Hc (L<Lc<Hc<H) in response to a counter inversion signal after the first refresh operation. Hence, the pixel PIX1 displays white (polarity is negative).

When the second refresh operation is started and the transfer line TL1 becomes inactive (Low), the memory electrode MRY1 is electrically disconnected from the pixel electrode PE1. This causes the memory electrode MRY1 to hold an electric potential L. Subsequently, the gate line GL1 becomes active (High), and an electric potential H is written in the pixel electrode PE1, via the source line SL. Note that the transfer transistor TB is still in an off-state, and therefore the memory electrode MRY1 holds the electric potential L. When the refresh line RL1 becomes active (High), the refresh transistor TD is turned on. However, the pixel electrode PE1 and the transfer line TL1 are not short-circuited. This is because the relay transistor TC whose gate terminal is connected to the memory electrode MRY (holding the electric potential L) is in an off-state. The pixel electrode PE1 still keeps the electric potential H. The second refresh operation is ended. When the transfer line TL1 becomes active (High), the pixel electrode PE1 and the memory electrode MRY1 are short-circuited. This causes the electric potential of the pixel electrode PE1 to be decreased, whereas the electric potential of the memory electrode MRY1 to be increased. As described above, the retention capacitor CCS1 is designed to have capacitance greater than that of the memory capacitor CMR1. Therefore, the electric potential of the memory electrode MRY1 is increased from the electric potential L to the vicinity of an electric potential H, whereas the pixel electrode PE1 keeps an electric potential equal to that of the memory electrode MRY1 (in the vicinity of the electric potential H) though the electric potential of the pixel electrode PE1 is slightly decreased from the electric potential H. Note that the electric potential VCOM becomes an electric potential Lc (L<Lc<Hc<H) in response to a counter inversion signal after the second refresh operation. Hence, the pixel PIX1 displays white (polarity is positive).

As shown in FIG. 4, a timing of a pixel PIX2, at which timing a data signal is written during a rewritten period, is delayed one (1) horizontal scanning period from that of the pixel PIX1. Note, however, that a timing of the pixel electrode PIX2, at which timing each refresh operation is conducted during a display holding period, is identical to that of the pixel PIX1. A pixel electrode PE2 has an electric potential L during the rewritten period, and the electric potential VCOM becomes the electric potential Lc (L<Lc<Hc<H). Therefore, the pixel PIX2 displays black (polarity is negative). The pixel electrode PE2 has an electric potential H after the first refresh operation, and the electric potential VCOM becomes the electric potential Hc (L<Lc<Hc<H). Therefore, the pixel PIX2 displays black (polarity is positive). The pixel PE2 has an electric potential L after the second refresh operation, and the electric potential VCOM becomes the electric potential Lc (L<Lc<Hc<H). Therefore, the pixel PIX2 displays black (polarity is negative).

Figure 5:
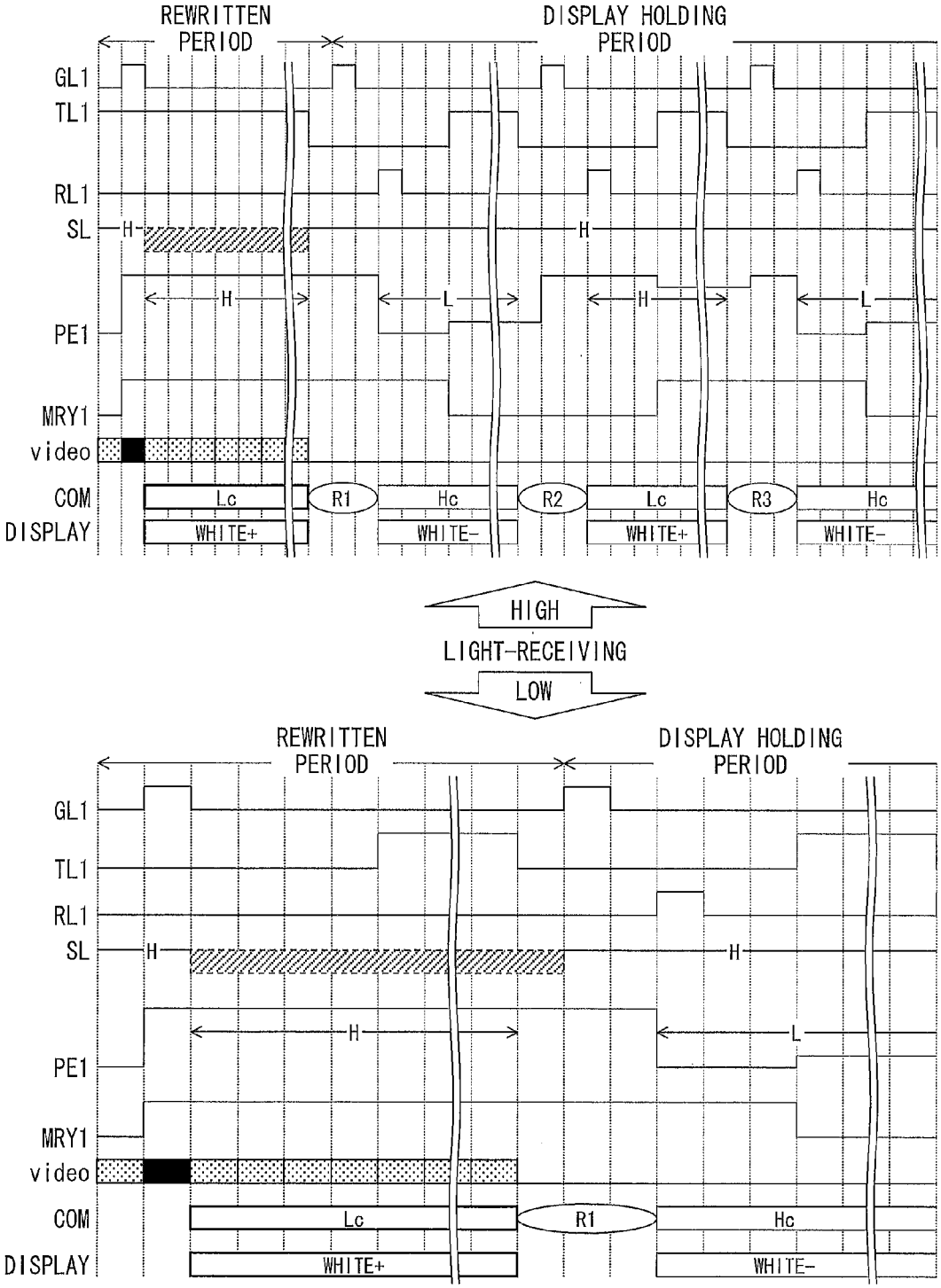
FIG. 5

As early described, in the liquid crystal display device of the present embodiment, the driving frequency of each of the gate signal, the data signal, the transfer signal, the refresh signal, and the counter inversion signal changes depending on the light-receiving intensity. For example, as shown in FIG. 5, it is assumed that a compression ratio of (i) signals (GL1, SL, TL1, RL1, and COM) obtained in a case of a low light-receiving intensity to (ii) signals (GL1, SL, TL1, RL1, and COM) obtained in a case of a high light-receiving intensity is 0.5 in view of time base. Further, it is assumed that (i) the frequency at which the screen is rewritten and (ii) the frequency at which the refresh operation is conducted during the display holding period, which frequencies are obtained in the case of the high light-receiving intensity, are made twice of those obtained in the case of the low light-receiving intensity (the rewritten intervals and the refresh intervals obtained in the case of the high light-receiving intensity are made half of those obtained in the case of the low light-receiving intensity). This makes it possible to reduce power consumption while maintaining display quality.

Figure 6:
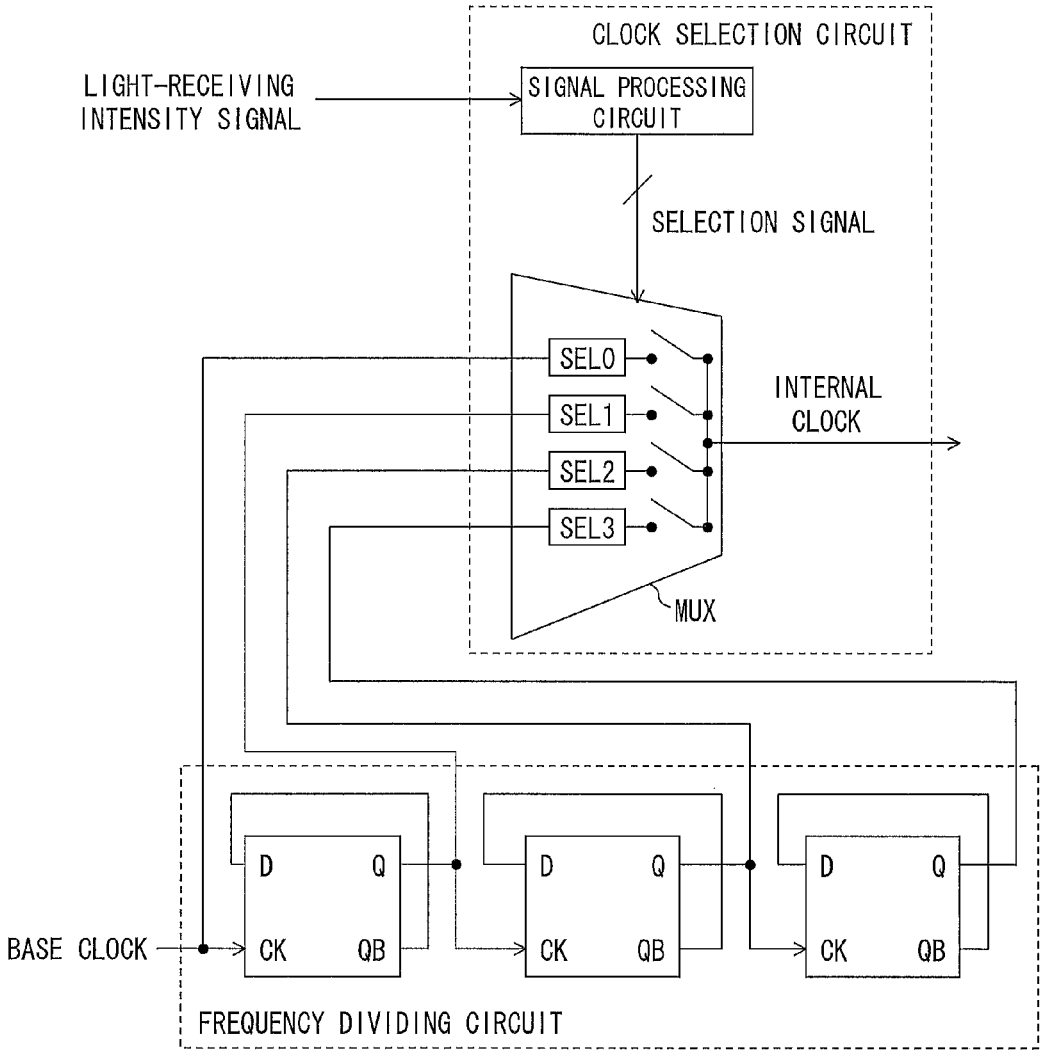
FIG. 6
Figure 7:
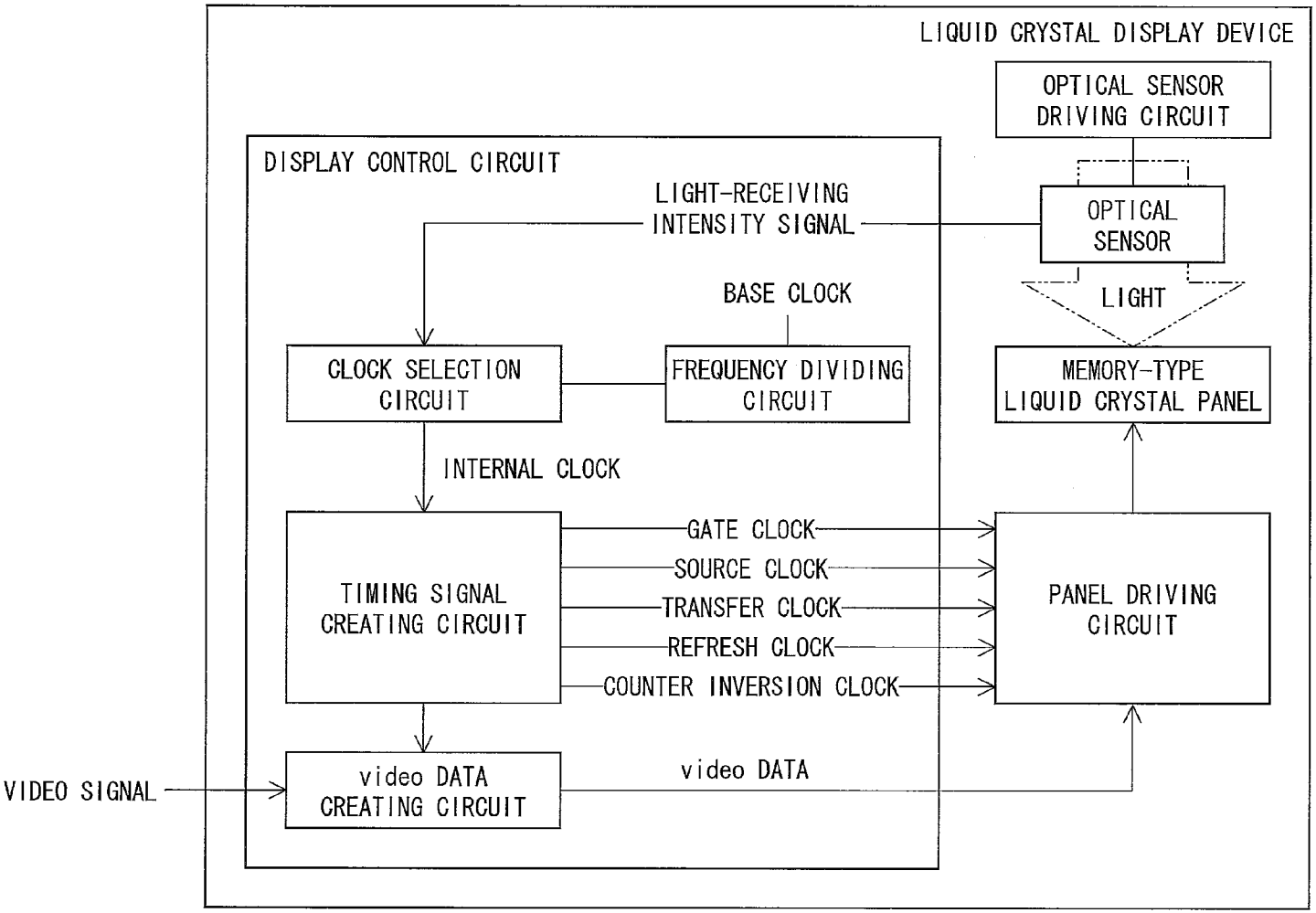
FIG. 7

FIG. 6 is a block diagram showing an example configuration of each of the clock selection circuit and the frequency dividing circuit in the display control circuit (see FIG. 2). The clock selection circuit includes a signal processing circuit for creating a selection signal in response to a light-receiving intensity signal, and a multiplexer MUX for selecting one of SEL0 through SEL3 in response to the selection signal. The frequency dividing circuit includes three D flip flops DF1 through DF3. The base clock is supplied to a CK terminal of the DF1. The DF1 has a D terminal connected to a QB terminal of the DF1. The DF1 has a Q terminal connected to a CK terminal of the DF2. The DF2 has a D terminal connected to a QB terminal of the DF2. The DF2 has a Q terminal connected to a CK terminal of the DF3. The DF3 has a D terminal connected to a QB terminal of the DF3. The base clock is also supplied to an SEL0 terminal of the MUX. The Q terminal of the DF1 is also connected to an SEL1 terminal of the MUX. The Q terminal of the DF2 is also connected to an SEL2 terminal of the MUX. The DF3 has a Q terminal connected to an SEL3 terminal of the MUX. This causes (i) the SEL0 to receive a base clock having a source frequency, (ii) the SEL1 to receive a clock having a half frequency of the source frequency, (iii) the SEL2 to receive a clock having a one-fourth frequency of the source frequency, and (iv) the SEL3 to receive a clock having a one-eighth frequency of the source frequency. It follows that the MUX switches and selects SEL0, SEL1, SEL2, or SEL3 in this order as a light-receiving intensity indicated by a selection signal increases. This causes an internal clock to be outputted in response to the receiving-light intensity. Note that it is possible to narrow a width of change in the internal clock, by increasing the frequency of the base clock. The base clock can be internally created by an oscillator or the like. Alternatively, the base clock can be externally supplied together with a video signal.

Figure 8:
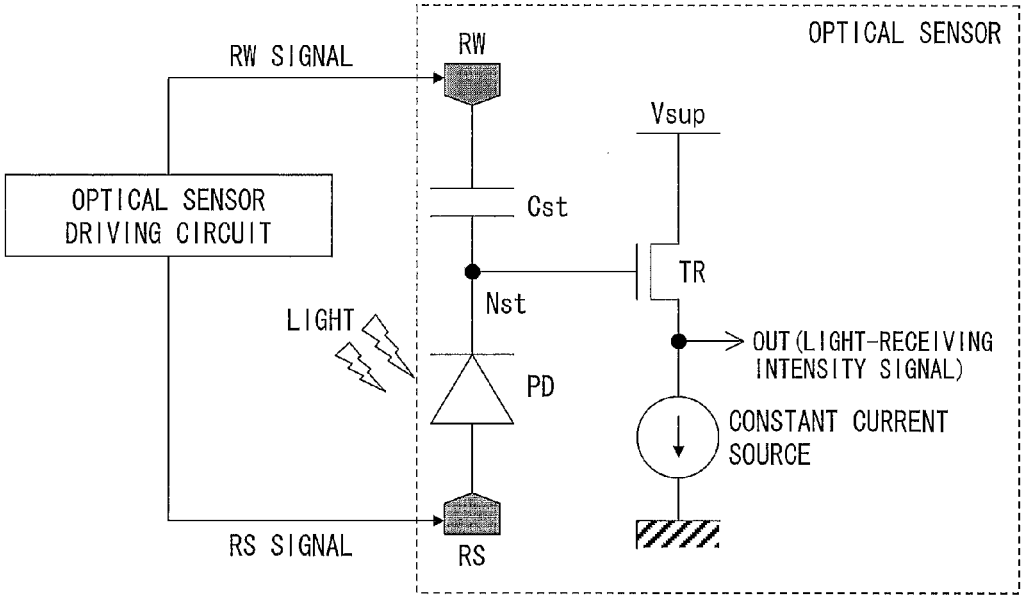
FIG. 8

Note that a light modulating signal of a backlight can be used as the light-receiving intensity signal. Alternatively, in a case where a liquid crystal display device includes the optical sensor and an optical sensor driving circuit separately (see FIG. 7), an output signal (detection signal) of an optical sensor can be used as the light-receiving intensity signal. FIG. 8 shows an example of an optical sensor. The optical sensor includes an RS terminal, an RW terminal, a capacitor Cst, a photodiode PD, a transistor TR, and a constant current source. The RS terminal is connected to an anode of the photodiode PD. The capacitor Cst is defined by a cathode (=storage node Nst) of the photodiode PD and the RW terminal. The cathode of the photodiode PD is connected to a gate terminal of the transistor TR. The transistor TR has a source terminal connected to a power supply Vsub, and a drain terminal (OUT terminal) connected to an upstream terminal of the constant current source. Note that the optical sensor driving circuit supplies an RS signal to the RS terminal, and supplies an RW signal to the RW terminal.

Figure 9:
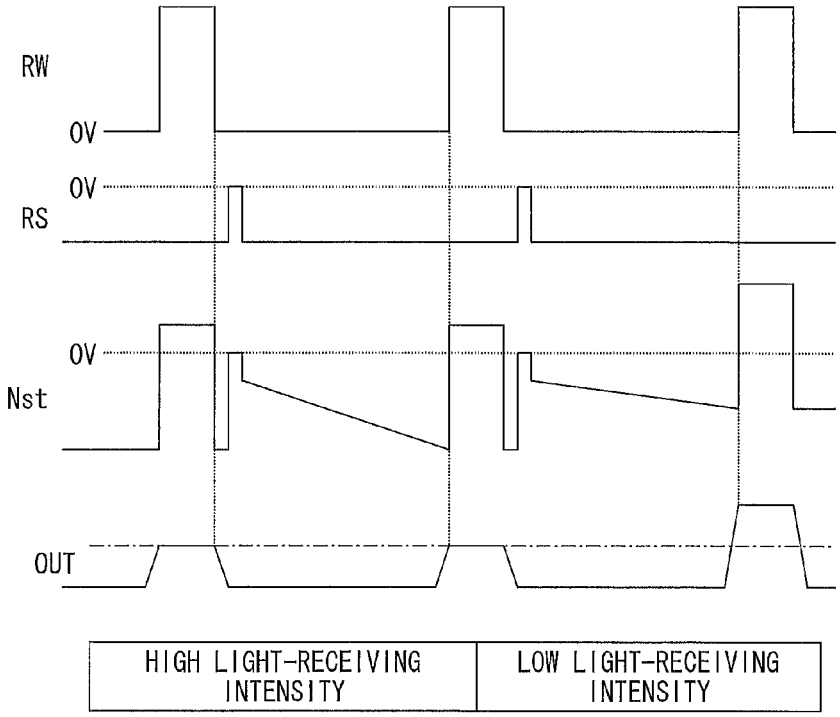
FIG. 9
Figure 10:
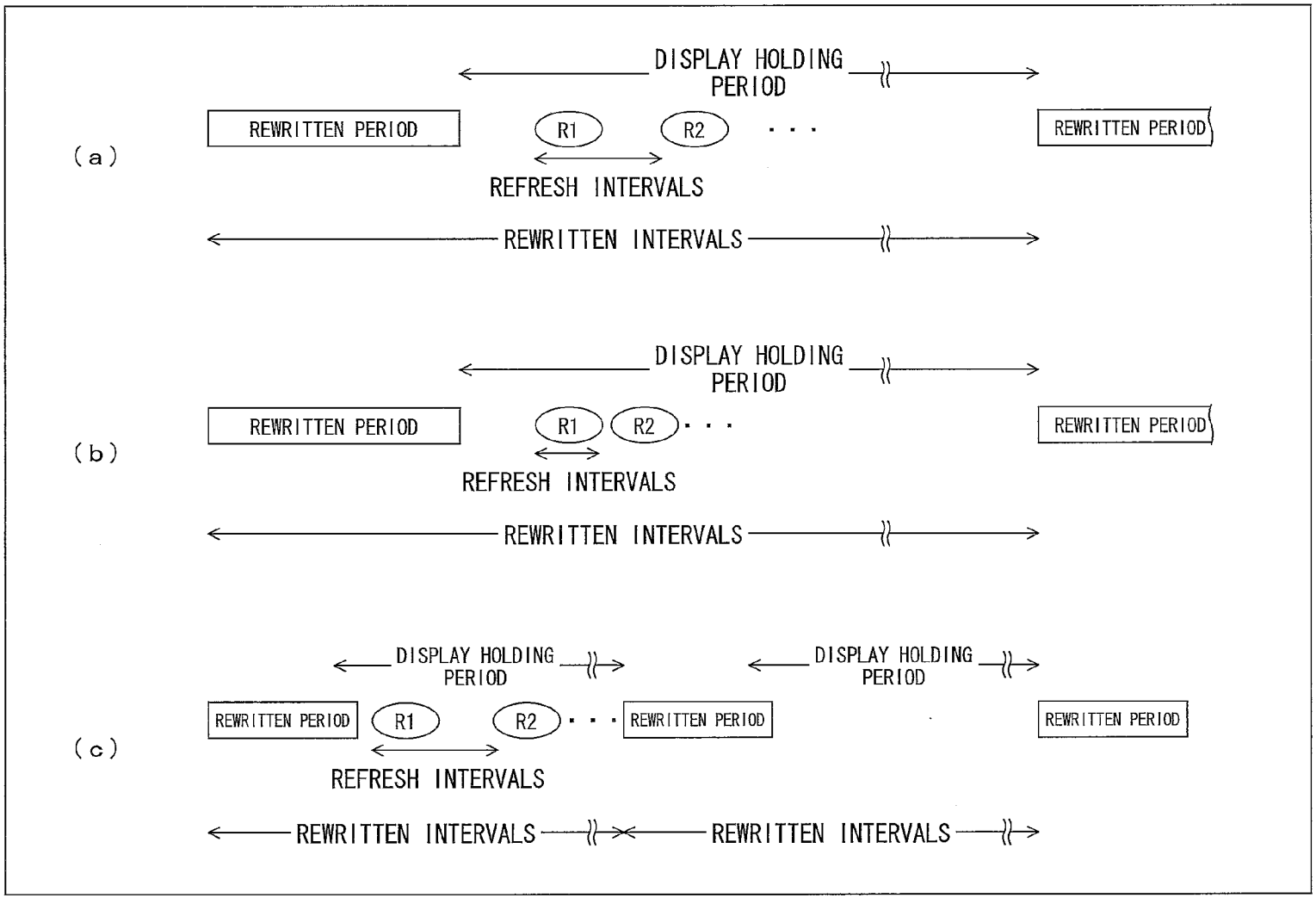
FIG. 10

As shown in FIG. 9, with the circuit configuration of the optical sensor shown in FIG. 8, an RS signal is first caused to have 0 V, so that a forward electric current flows through the photodiode PD. This causes the storage node Nst to be reset to 0 (V) (reset process). Subsequently, the RS signal is caused to have −b (V), so that a backward electric current flows through the photodiode PD in response to a light-receiving intensity. This causes an electric potential of the storage node Nst to be pulled down in a negative direction by an electric potential corresponding to the light-receiving intensity (sensing process). Subsequently, the electric potential of the storage node Nst is pulled up in response to the RW signal so that a drain current flows through the transistor TR in accordance with a pulled-up electric potential of the storage node Nst. This allows an analog electric potential (light-receiving intensity signal) to be outputted, via the OUT terminal, in accordance with the light-receiving intensity (writing process). Note that the analog electric potential of the OUT terminal is supplied to the clock selection circuit as a light-receiving intensity signal, is subjected to analog-to-digital conversion by a signal processing circuit in the clock selection circuit, and is then supplied to the multiplexer MUX as a selection signal (see FIG. 6).

In FIG. 5, the compression ratio, in the time axis direction, of (i) the signals (GL1, SL, TL1, RL1, and COM) obtained in the case of the high light-receiving intensity to (ii) the signals (GL1, SL, TL1, RL1, and COM) obtained in the case of the low light-receiving intensity is less than 1. Therefore, the rewritten intervals, the refresh intervals, and the rewritten period are shortened. However, the present embodiment is not limited to this. For example, as shown in (a) and (b) of FIG. 10, the rewritten intervals and the refresh intervals can be shortened while the rewritten period is as it is. Alternatively, as shown in (a) and (c) of FIG. 10, the rewritten intervals and the rewritten period can be shortened while the refresh intervals are as they are. Alternatively, merely the refresh intervals can be shortened while the rewritten intervals are as they are (not shown).

The configuration of the memory circuit of the liquid crystal display device of the present embodiment is not limited to the configuration of FIG. 3. For example, a memory-type liquid crystal panel illustrated in FIG. 11 (see Patent Literature 1) can be employed. The memory-type liquid crystal panel includes a gate line gL1, a source line sL, a transfer line tL1, a refresh line rL1, a retention capacitor wiring csL1, a high electric potential power supply line pHL, a low electric potential power supply line pLL, a main transistor Ta1 whose gate terminal is connected to the gate line gL1, a pixel pix1 including (i) a pixel electrode Pe1 and (ii) a counter electrode com, and a memory circuit mc1 for the pixel pix1. The memory circuit mc1 includes a transfer transistor Tb whose gate terminal is connected to the transfer line tL1, a refresh transistor Td whose gate terminal is connected to the refresh line rL1, a memory electrode mry1, and an inverter circuit iC connected to the high electric potential power supply line pHL and the low electric potential power supply line pLL. A liquid crystal capacitor clc1 is defined by the pixel electrode Pe1 and the counter electrode com. A retention capacitor ccs1 is defined by the retention capacitor wiring csL1 and the pixel electrode Pe1. A memory capacitor cmr1 is defined by the retention capacitor wiring csL1 and the memory electrode mry1.

The main transistor Ta1 has a source terminal connected to the source line sL and a drain terminal connected to the pixel electrode Pe1. The pixel electrode Pe1, a source terminal of the transfer transistor Tb, and a source terminal of the refresh transistor Td are connected to one another. The inverter circuit iC has (i) an input terminal connected to the memory electrode mry1 and (ii) an output terminal connected to a drain terminal of the refresh transistor Td. The transfer transistor Tb has a drain terminal connected to the memory electrode mry1.

Figure 11:
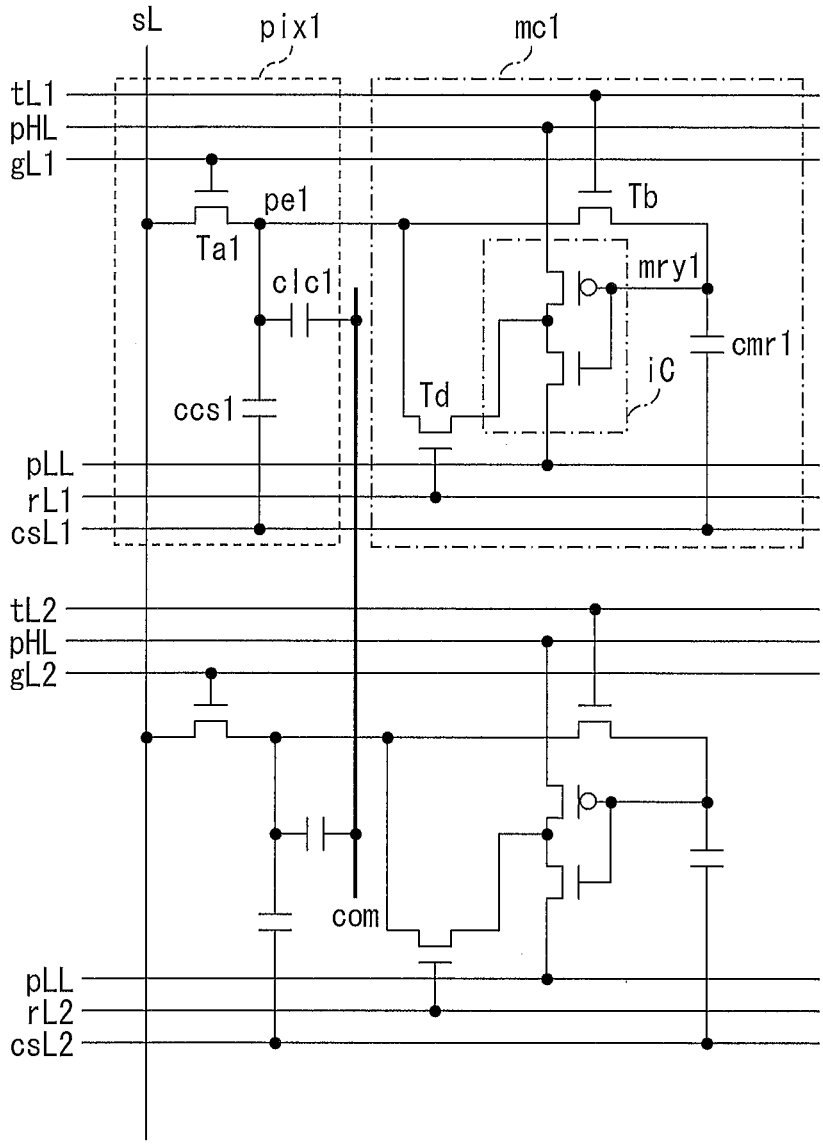
FIG. 11

Even in a liquid crystal display device including the memory-type liquid crystal panel of FIG. 11, it is possible to shorten rewritten intervals and refresh intervals by increasing, as a light-receiving intensity increases, a driving frequency of each of a gate signal to be supplied to the gate line gL1, a data signal to be supplied to the source line sL, a transfer signal to be supplied to the transfer line tL1, a refresh signal to be supplied to the refresh line rL1, and a counter inversion signal to be supplied to the counter electrode com.

A liquid crystal display device of the present invention, is a liquid crystal display device of memory-type, including a liquid crystal panel including memory circuits, which conducts a refresh operation more than once during a display holding period after rewriting of a screen, wherein at least one of (i) a frequency at which the screen is rewritten and (ii) a frequency at which a refresh operation is conducted during the display holding period, is increased as an intensity of light received by the liquid crystal panel increases.

In the liquid crystal display device of the present invention, at least one of (i) the frequency at which the screen is rewritten and (ii) the frequency at which the refresh operation is conducted during the display holding period is increased, and at least one of intervals at which the screen is rewritten and intervals at which the refresh operation are conducted is shortened, in a case where a state of a low light-receiving intensity where an image quality is unlikely to be deteriorated is changed, during the display holding period, to a state of a high light-receiving intensity where the image quality is likely to be deteriorated. This allows the liquid crystal display device of the present invention to reduce power consumption while keeping its display quality.

The liquid crystal display device of the present invention can be further configured such that intervals at which the screen is rewritten become narrower as the intensity of light increases.

The liquid crystal display device of the present invention can be further configured such that intervals at which the refresh operation is conducted become smaller as the intensity of light increases.

The liquid crystal display device of the present invention can be further configured such that the liquid crystal panel includes gate lines, source lines, transfer lines, refresh lines, retention capacitor lines, main transistors each of which has a control terminal connected to a corresponding one of the gate lines, pixels each of which includes a pixel electrode and a counter electrode, and the memory circuits for the respective pixels, each of the memory circuits includes (i) a transfer transistor whose control terminal is connected to a corresponding one of the transfer lines, (ii) a refresh transistor whose control terminal is connected to a corresponding one of the refresh lines, (iii) a memory electrode, and (iv) a relay transistor whose control terminal is connected to the memory electrode, a capacitor is defined by a corresponding one of the retention capacitor lines and a corresponding one of the pixel electrodes, and a capacitor is defined by the corresponding one of the retention capacitor lines and a corresponding one of the memory electrodes, and each of the pixel electrodes is connected to (i) a corresponding one of the source lines via a corresponding one of the main transistors, (ii) the corresponding one of the memory electrodes via a corresponding one of the transfer transistors, and (iii) the corresponding one of the transfer lines via a corresponding one of the refresh transistors and a corresponding one of the relay transistors.

The liquid crystal display device of the present invention can be further configured such that each driving frequency of the gate lines, the transfer lines, and the refresh lines is increased as the intensity of light increases.

The liquid crystal display device of the present invention can be further configured such that the screen is rewritten by sequentially selecting a gate line while outputting a data signal electric potential to a corresponding one of the source lines, in a state where a corresponding one of the transfer lines is kept active.

The liquid crystal display device of the present invention can be further configured such that a constant electric potential, by which a corresponding one of the relay transistors is turned on, is applied via a corresponding one of the source lines during the display holding period.

The liquid crystal display device of the present invention can be further configured such that the refresh operation is conducted, while keeping the transfer lines inactive, during the display holding period by simultaneous rendering of the refresh lines into active after simultaneous rendering of the gate lines into active.

The liquid crystal display device of the present invention can be further configured such that two electric potentials are alternately applied to each of the counter electrodes every time the refresh operation is conducted.

The liquid crystal display device of the present invention can be further configured such that the two electric potentials are larger than a minimum data signal electric potential but smaller than a maximum data signal electric potential.

The liquid crystal display device of the present invention can be further configured to include: a backlight; and a display control circuit for switching, in response to a light modulating signal of the backlight, at least one of the frequency at which the screen is rewritten and the frequency at which the refresh operation is conducted during the display holding period.

The liquid crystal display device of the present invention can be further configured to include: an optical sensor; and a display control circuit for switching, on the basis of a result detected by the optical sensor, at least one of the frequency at which the screen is rewritten and the frequency at which the refresh operation is conducted during the display holding period.

A method for driving the liquid crystal display device of the present invention, is a method for driving a liquid crystal display device of memory-type, said liquid crystal display device including a liquid crystal panel including memory circuits, and conducting a refresh operation more than once during a display holding period after rewriting of a screen, said method comprising the step of: increasing at least one of (i) a frequency at which the screen is rewritten and (ii) a frequency at which a refresh operation is conducted during the display holding period, as an intensity of light received by the liquid crystal panel increases.

The present invention is not limited to the above-described embodiment, and an embodiment of the present invention encompasses an embodiment derived from (i) a proper change in the above-described embodiment on the basis of a publicly-known technique or common general technical knowledge or (ii) a proper combination of embodiments obtained by the proper change. Further, the effect or the like described in the above-described embodiment is just an example of the present invention.

INDUSTRIAL APPLICABILITY

A liquid crystal display device of the present invention is suitably applicable to, for example, a display of a mobile phone.

REFERENCE SIGNS LIST pix, PIX: pixel
PE1, pe1: pixel electrode
MRY1, mry1: memory electrode
TA, Ta: main transistor
TB, Tb: transfer transistor
TD, Td: refresh transistor
TC: transfer transistor
GL1, gL1: gate line
SL, sL: source line
TL1, tL1: transfer line
RL1, rL1: refresh line
R1: the first refresh operation
R2: the second refresh operation

The invention claimed is:

1. A memory-type liquid crystal display device, comprising:

a liquid crystal panel including memory circuits, the liquid crystal panel being configured to conduct a refresh operation more than once during a display holding period after rewriting of a screen;

wherein at least one of (i) a frequency at which the screen is rewritten and (ii) a frequency at which a refresh operation is conducted during the display holding period, is increased as an intensity of light received by the liquid crystal panel increases;

wherein the liquid crystal panel includes gate lines, source lines, transfer lines, refresh lines, retention capacitor lines, main transistors, pixels, and memory circuits for respective pixels;

wherein each of the main transistors has a control terminal connected to a corresponding one of the gate lines, and each of the pixels include a pixel electrode and a counter electrode;

wherein each of the memory circuits includes (i) a transfer transistor having a control terminal connected to a corresponding one of the transfer lines, (ii) a refresh transistor having a control terminal connected to a corresponding one of the refresh lines, (iii) a memory electrode, and (iv) a relay transistor having a control terminal connected to the memory electrode;

wherein a first capacitor is defined by a corresponding one of the retention capacitor lines and a corresponding one of the pixel electrodes, and a second capacitor is defined by the corresponding one of the retention capacitor lines and a corresponding one of the memory electrodes; and wherein each of the pixel electrodes is connected to (i) a corresponding one of the source lines via a corresponding one of the main transistors, (ii) the corresponding one of the memory electrodes via a corresponding one of the transfer transistors, and (iii) the corresponding one of the transfer lines via a corresponding one of the refresh transistors and a corresponding one of the relay transistors.

2. The liquid crystal display device as set forth in claim 1, wherein:

intervals at which the screen is rewritten become narrower as the intensity of light increases.

3. The liquid crystal display device as set forth in claim 1, wherein:

intervals at which the refresh operation is conducted become smaller as the intensity of light increases.

4. The liquid crystal display device as set forth in claim 1, wherein:

each driving frequency of the gate lines, the transfer lines, and the refresh lines is increased as the intensity of light increases.

5. The liquid crystal display device as set forth in claim 1, wherein:

the screen is rewritten by sequentially selecting a gate line while outputting a data signal electric potential to a corresponding one of the source lines, in a state where a corresponding one of the transfer lines is kept active.

6. The liquid crystal display device as set forth in claim 5, wherein:

a constant electric potential, by which a corresponding one of the relay transistors is turned on, is applied via a corresponding one of the source lines during the display holding period.

7. The liquid crystal display device as set forth in claim 6, wherein:

the refresh operation is conducted, while keeping the transfer lines inactive, during the display holding period by simultaneously rendering the refresh lines active after simultaneously rendering the gate lines active.

8. The liquid crystal display device as set forth in claim 7, wherein:

two electric potentials are alternately applied to each of the counter electrodes every time the refresh operation is conducted.

9. The liquid crystal display device as set forth in claim 8, wherein:

the two electric potentials are larger than a minimum data signal electric potential but smaller than a maximum data signal electric potential.

10. The liquid crystal display device as set forth in claim 1, further comprising:

a backlight; and a display control circuit for switching, in response to a light modulating signal of the backlight, at least one of the frequency at which the screen is rewritten and the frequency at which the refresh operation is conducted during the display holding period.

11. The liquid crystal display device as set forth in claim 1, further comprising:

an optical sensor; and a display control circuit for switching, on the basis of a result detected by the optical sensor, at least one of the frequency at which the screen is rewritten and the frequency at which the refresh operation is conducted during the display holding period.

* * * * *